US007490366B1

(12) United States Patent
Richter

(10) Patent No.: US 7,490,366 B1
(45) Date of Patent: Feb. 17, 2009

(54) BOLT ASSEMBLY FOR THE ATTACHMENT OF TOILET SEATS AND OTHER ARTICLES

(76) Inventor: Milton Richter, P.O. Box 483, Kiamesha Lake, NY (US) 12751

( * ) Notice: Subject to any disclaimer, the term of this patent is extended or adjusted under 35 U.S.C. 154(b) by 0 days.

(21) Appl. No.: 11/827,544

(22) Filed: Jul. 12, 2007

(51) Int. Cl.
*A47K 13/12* (2006.01)

(52) U.S. Cl. ..... 4/240; 4/236

(58) Field of Classification Search ..... 4/234–241, 4/242.1; 411/80.6, 71, 48, 60.3, 72, 355, 411/34
See application file for complete search history.

(56) References Cited

U.S. PATENT DOCUMENTS

| | | | | | |
|---|---|---|---|---|---|
| 651,354 | A * | 6/1900 | Hogan | 4/236 |
| 2,500,594 | A * | 3/1950 | Young | 4/236 |
| 3,449,774 | A * | 6/1969 | Wilham | 4/240 |
| 4,079,471 | A | 3/1978 | Corda | 4/240 |
| 5,457,824 | A | 10/1995 | Reed | 4/234 |
| 5,667,348 | A * | 9/1997 | Chen et al. | 411/420 |
| 5,919,020 | A * | 7/1999 | Walther | 411/399 |
| 5,925,048 | A * | 7/1999 | Ahmad et al. | 606/73 |
| 5,933,875 | A | 8/1999 | Hulsebus et al. | 4/240 |
| 6,012,886 | A * | 1/2000 | Tanamura et al. | 4/240 |
| 6,101,640 | A * | 8/2000 | Brewer et al. | 4/236 |
| 6,102,642 | A * | 8/2000 | Kawashita et al. | 411/401 |
| 6,381,762 | B1 | 5/2002 | Moser | 4/240 |
| D485,163 | S * | 1/2004 | Twomey | D8/399 |
| 6,763,529 | B1 | 7/2004 | Richter | 4/240 |
| 6,931,672 | B1 * | 8/2005 | Richter | 4/240 |
| 2007/0089222 | A1 * | 4/2007 | Leibfried | 4/236 |

FOREIGN PATENT DOCUMENTS

| | | |
|---|---|---|
| GB | 2167096 | 11/1985 |

* cited by examiner

*Primary Examiner*—Huyen Le
(74) *Attorney, Agent, or Firm*—Sandra M. Kotin

(57) ABSTRACT

A bolt assembly for use with toilet seats and other objects consists of a threaded bolt with a threaded axial bore and a head larger than the opening in the toilet bowl flange, a nut sized to fit the bolt, and a screw dimensioned to cooperate with the bore. The bolt is inserted through the opening in the flange, extending there beyond. The bolt is secured from below the flange with the nut. The seat assembly is then placed on the flange so that the aperture in the seat assembly bracket communicates with the threaded bore. The seat assembly is secured in place by passing the screw through the aperture in the bracket and threading it into the bore. The seat assembly can then be reversibly removed for cleaning by merely removing and replacing the screw without having to reach under the flange. The screw can have a gripping head so that it can be rotated without the need for a screwdriver, or there can be a slot centered on the top of the head so that a screwdriver can be used. The slot can be sized to accept a screwdriver but such that it will not permit the screwdriver to slip sideways during use.

14 Claims, 3 Drawing Sheets

BOLT ASSEMBLY FOR THE ATTACHMENT OF TOILET SEATS AND OTHER ARTICLES

FIELD OF THE INVENTION

The instant invention relates to bolt assemblies for the secure attachment of a toilet seat assembly to the toilet bowl flange while enabling the seat portion to be easily and reversibly removed for cleaning without having to reach under the flange.

BACKGROUND OF THE INVENTION

The common toilet seat assembly has been known for over a century. The installation of the toilet seat assembly has always required the installer to maneuver under the back end or flange of the toilet bowl to reach the attaching bolt and fasten the nut. This type of installation has always made removal of the toilet seat assembly for cleaning a cumbersome task. The result has been that the seat assembly is usually only removed when there is a need to change it. Additionally, after remaining in place for a considerable period of time, the nuts and bolts that maintain the seat assembly in place are often badly corroded making removal very difficult, and more so when it is necessary to reach under the flange or get down beneath the flange to perform this task.

A seat assembly that can be easily removed and replaced is taught by Corda in U.S. Pat. No. 4,079,471. A threaded post having a smooth upper portion extending above a flat integral washer is set into each hole in the bowl flange and secured from below with a nut. The bracket of the seat assembly has two smooth walled cylindrical bushings that fit over the smooth upper portions of the posts enabling the seat assembly to be taken off and replaced while the posts remain in place. After time the connections can become worn and loose so that the seat assembly will no longer be held securely in place. A similar arrangement is taught by Hulsebus et al. in U.S. Pat. No. 5,933,875 where the bolts are passed downward through base members and the holes in the bowl flange and are secured with nuts under the flange. Locking members that cooperate with the base members above the flange fasten the seat assembly in place. The locking members enable the seat assembly to be removed and replaced. See also U.S. Pat. No. 6,381,762 to Moser in which there are heads on the two posts that extend above the flange over which are placed the seat bracket which contains a trough designed to receive the post heads. These patents require the seat brackets to be manufactured to fit the base members and the posts. Richter, in U.S. Pat. No. 6,763,529 describes a threaded rod inserted through the flange opening and secured above and below the flange with nuts. The rod extends upward above the flange and through the hole in the bracket of the seat assembly where it is secured with a third nut. The rough end of the threaded rod is exposed and must be covered by a bracket designed for this purpose.

Reed, in U.S. Pat. No. 5,457,824 discloses a hollow bolt, threaded on its outer surface, smooth in the inner surface and having a rim about the top that is larger in diameter then the opening in the toilet bowl flange. The bolt is placed in the hole in the flange and secured from below with a nut. There is also a hollow pin that fits snugly within the hollow bolt. The pin is smooth on its outer surface, threaded within and has a rim about the top that is larger in diameter then the opening in the toilet seat mounting bracket. There are four vertical slots around the top of the pin. The pin is dropped into the opening in the mounting bracket and a screw having a slightly larger diameter then the hollow of the pin is threaded into the pin so that the upper area is expanded to permanently secure the pin into the opening in the mounting bracket. To place the seat assembly onto the toilet bowl flange the pins are slipped into the smooth hollows of the bolts. To remove the seat assembly it is gripped in two hands and lifted vertically. Repeated removal and replacement can cause damage to the pin or cause wear within the hollow so that over time, the fit will not remain tight.

UK Patent application No. 2167096 to Boorman also discloses a hollow threaded bolt with a rim about the top that is secured to the toilet bowl flange from below with a nut. There is a central area within the hollow of the bolt that is of larger diameter. A spigot having a bulge that cooperates with the larger diameter area of the hollow can be placed within the hollow. The spigot also has a collar to prevent its being forced too far into the hollow and a threaded portion that extends above the collar. A specially shaped nut is threaded onto the top of each spigot. These nuts cooperate with and are attached to the mounting bracket sections of the toilet seat assembly. To attach the seat assembly to the flange the spigots are snap fitted into the hollow bolts and the seat is securely held in place. To remove the seat assembly the bracket must be grasped and pulled upward to release the snap fit. This bolt assembly is designed to be used with a complementing seat assembly and cannot be used with other existing systems. The parts are made of a plastic material and the snap fit can wear and become loose after repeated removals.

There is a need for a bolt assembly that can be used with toilet seat systems currently on the market so that the seats can be easily removed for cleaning without requiring any refitting or special apparatus. There is a need for a bolt assembly that does not rely on a snap fit or friction fit. There is a need for a bolt assembly that is easy and inexpensive to manufacture and easy to use without the need for any tools. There is a need for such a bolt assembly that will not wear out after repeated use.

BRIEF SUMMARY OF THE INVENTION

The present invention provides a simple three piece bolt assembly that can be used to reversibly fasten a toilet seat assembly to the flange of a toilet bowl. This assembly can also be used to securely and reversibly connect a variety of other two part systems.

It is an object of the present invention to provide a bolt assembly that can be used with toilet seats currently on the market and in use.

Another object of the present invention is to provide a bolt assembly composed of three simple pieces that fit together to form a compact unit.

It is a further object of the present invention to provide a bolt assembly that enables the toilet seat to be removed for cleaning without the need for any tools.

A still further object of the present invention is to provide a bolt assembly that can also accommodate the use of a screw driver while assuring a quick and easy installation without the screw driver slipping.

Another object of the present invention is to provide a bolt assembly that is inexpensive to manufacture.

A further object of the present invention is to provide a bolt assembly that will not wear out after considerable use so the seat remains securely fastened.

The present invention is a bolt assembly for mounting on a toilet bowl flange having at least one corresponding vertical opening. The bolt assembly comprises a toilet seat assembly in combination with a mounting bracket having at least one aperture, at least one threaded bolt having an axial threaded bore, an upper end and a lower end, and a collar about the upper end, the collar being larger in diameter than the vertical opening in the flange, and the bolt being substantially longer than the thickness of the flange. There is at least one nut for being threaded onto the lower end of the at least one bolt after the at least one bolt has been inserted downwardly into the at least one vertical opening in the flange with the at least one nut securely affixing the at least one bolt to the flange and insuring that the at least one bolt is immovable therein. There is also at least one screw, being shorter than the at least one bolt, having a threaded shaft to cooperate with the threaded bore and a head larger than the at least one aperture in the mounting bracket so that when the mounting bracket is placed over the flange and the at least one aperture is directly over the bore in the at least one bolt, the at least one screw is passed through the at least one aperture and threaded into the bore by rotating said screw in a first direction to secure the mounting bracket and thereby the toilet seat assembly to the flange and when the at least one screw is rotated in a second direction and removed from the bore the toilet seat assembly is completely removed from the flange. The toilet seat assembly is easily removed for cleaning and is just as easily replaced after cleaning.

The present invention is a bolt assembly for mounting on a toilet bowl flange having at least one corresponding vertical opening. The bolt assembly comprises a toilet seat assembly in combination with a mounting bracket having at least one aperture, at least one threaded bolt having an axial threaded bore, an upper end and a lower end, and a collar about the upper end, the collar being larger in diameter than the vertical opening in the flange, and the bolt being substantially longer than the thickness of the flange. There is at least one nut for being threaded onto the lower end of the at least one bolt after the at least one bolt has been inserted downwardly into the at least one vertical opening in the flange with the at least one nut securely affixing the at least one bolt to the flange and insuring that the at least one bolt is immovable therein. There is also at least one screw, being shorter than the at least one bolt, having a threaded shaft to cooperate with the threaded bore and a head larger than the at least one aperture in the mounting bracket and comprising an integral plate having an upper surface and a lower surface and being larger in diameter that the at least one aperture in the mounting bracket and a grip integral with and disposed on the upper surface of the plate, so that when the mounting bracket is placed over the flange and the at least one aperture is directly over the bore in the at least one bolt, the at least one screw is passed through the at least one aperture and threaded into the bore by rotating the screw in a first direction to secure the mounting bracket and thereby the toilet seat assembly to the flange and when the at least one screw is rotated in a second direction and removed from the bore the toilet seat assembly is completely removed from the flange. The toilet seat assembly is easily removed for cleaning and is just as easily replaced after cleaning.

The present invention is also a bolt assembly for mounting a toilet seat assembly in combination with a mounting bracket having at least one aperture on a toilet bowl flange having at least one corresponding vertical opening which comprises at least one threaded bolt having an axial threaded bore, an upper end and a lower end, and a collar about the upper end, the collar being larger in diameter than the vertical opening in the flange, and the bolt being substantially longer than the thickness of the flange and at least one nut for being threaded onto the lower end of the at least one bolt after the at least one bolt has been inserted downwardly into the at least one vertical opening in the flange, the at least one nut for securely affixing said at least one bolt to the flange and insuring that the at least one bolt is immovable therein. There is also at least one screw that is shorter than the at least one bolt, has a threaded shaft to cooperate with the threaded bore, and an integral head which comprises a plate having an upper surface and a lower surface and being larger in diameter than the at least one aperture in the mounting bracket, a grip integral with and disposed on the upper surface of the plate, and a horizontal slot in the center of the top surface of the grip of a width to accommodate a screwdriver whereby the screwdriver cannot slip laterally during use. When the mounting bracket is placed over the flange and the at least one aperture is directly over the bore in the at least one bolt, the at least one screw is passed through the at least one aperture and threaded into the bore by rotating said screw in a first direction the mounting bracket and thereby the toilet seat assembly is secured to the flange, and when the at least one screw is rotated in a second direction and removed from the bore the mounting bracket and thereby the toilet seat assembly is completely removed from the flange. The toilet seat assembly is easily completely removed for cleaning and is just as easily replaced after cleaning.

Other features and advantages of the invention will be seen from the following description and drawings.

DETAILED DESCRIPTION OF THE INVENTION

The bolt assembly 10 of the present invention may be designed to enable rapid and easy reversible removal of the toilet seat for cleaning. The bolt assembly 10 may be used with any conventional toilet bowl having a rear flange with two vertical cylindrical openings therethrough. The design may insure compatibility with toilet fixtures having flanges of different thickness. The initial step in attaching the toilet seat may require minimal access below the flange, but subsequent removal and replacement of the seat may be accomplished entirely from above the flange.

Figure 1:
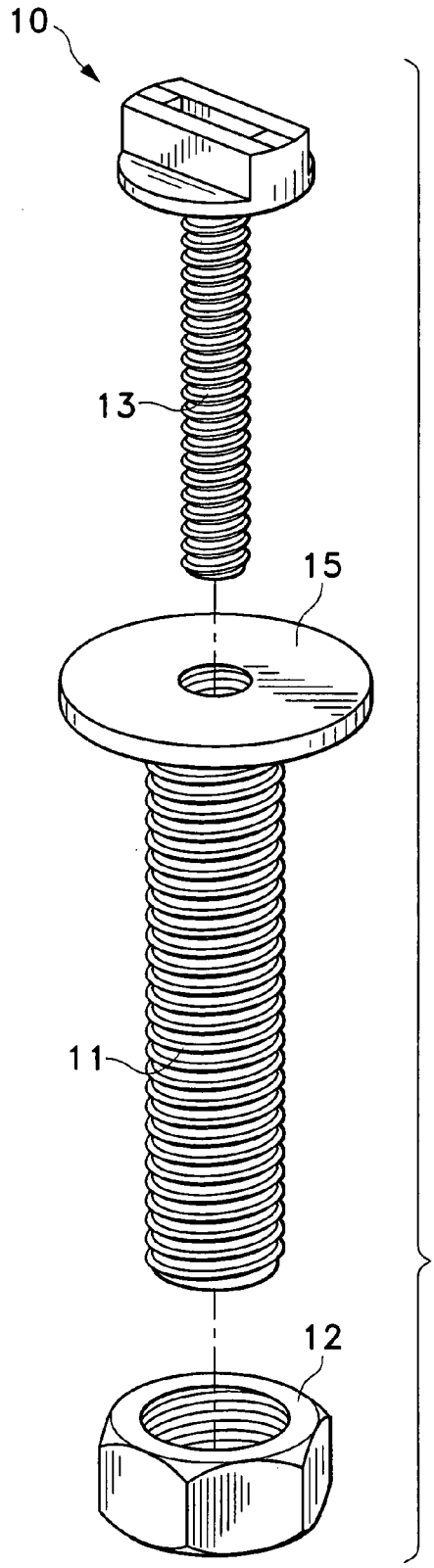
FIG. 1 is an exploded view of the bolt assembly of the present invention.
Figure 2:
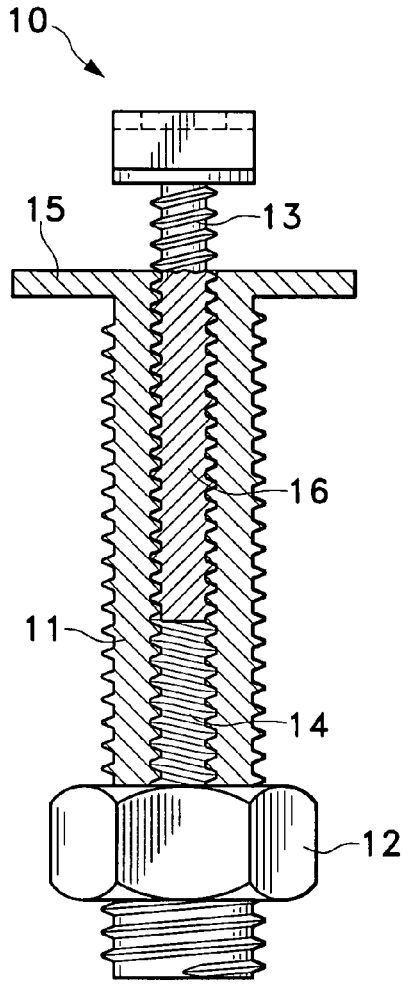
FIG. 2 is a partial vertical section of the bolt assembly.

The bolt assembly 10 may consist of three components as seen in FIGS. 1 and 2, a bolt 11, a nut 12 and a screw 13. The bolt 11 may be threaded on its exterior surface and may have a threaded bore 14 extending axially along its full length. There may be a collar 15 about the upper end of the bolt 11. The collar 15 may be sufficiently larger in diameter than the opening in the flange of the toilet bowl so the bolt 11 cannot slip through the opening. The collar 15 may also be thin and flat so that it may lie flush against the flange and not interfere with the placement of the seat bracket on the flange. It may be round, but other shapes may be acceptable.

The nut 12 may be hexagonal in shape, though it may also be square or otherwise shaped. The nut 12 may have a threaded axial opening to cooperate with the threading on the exterior surface of the bolt 11.

Figure 4:
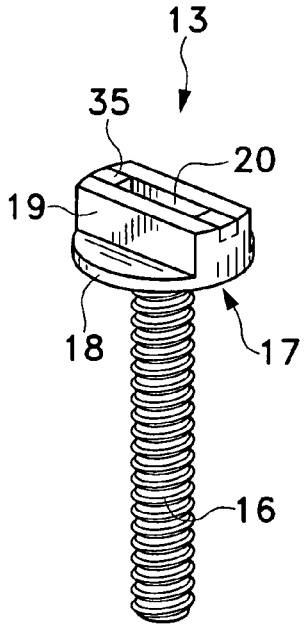
FIG. 4 is a perspective view of one embodiment of the screw.

The screw 13, seen in FIG. 4, may have a threaded shaft 16 to cooperate with the threaded bore 14 within the bolt 11. The head portion 17 of the screw 13 may consist of a thin circular plate 18 integral with the shaft 16. The plate 18 may be larger than the diameter of the opening 33 in the toilet seat bracket and of the bore 14 and may act as a stop when the screw 13 is threaded through the bracket into the bore 14. Above the plate 18 and integral therewith may be a substantially rectangular solid head or grip 19. The grip 19 may be large enough so that the user may grasp the grip 19 and turn it to tighten the screw 13 into the bore 14 without the necessity of a screwdriver. However, there may also be a horizontal slot 20 across the top of the grip 19 to receive a screwdriver if the user wishes to utilize one.

Figure 5:
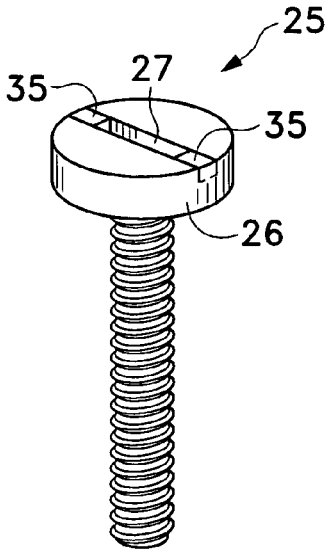
FIG. 5 is a perspective view of another embodiment of the screw.

A second embodiment of the screw 25 seen in FIG. 5 may have a thick round or otherwise shaped head 26 larger than the diameter of the opening 33 in the toilet seat bracket and having a horizontal slot 27 to accept a screwdriver, which must be used with this embodiment.

Two bolt assemblies 10 may be used with the conventional toilet seat assemblies currently on the market.

Figure 3:
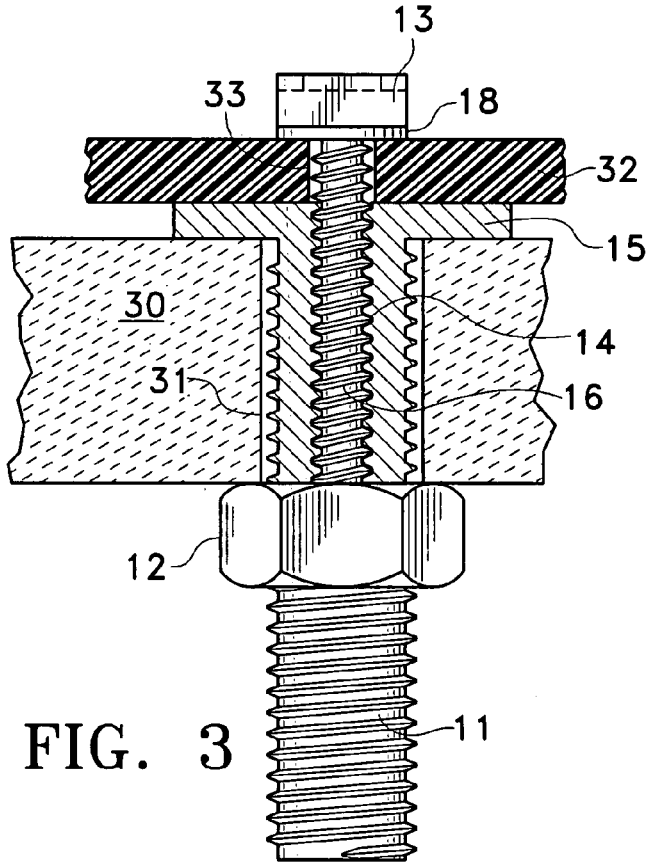
FIG. 3 is a partial vertical section of the bolt assembly with the toilet seat in place.
Figure 8:
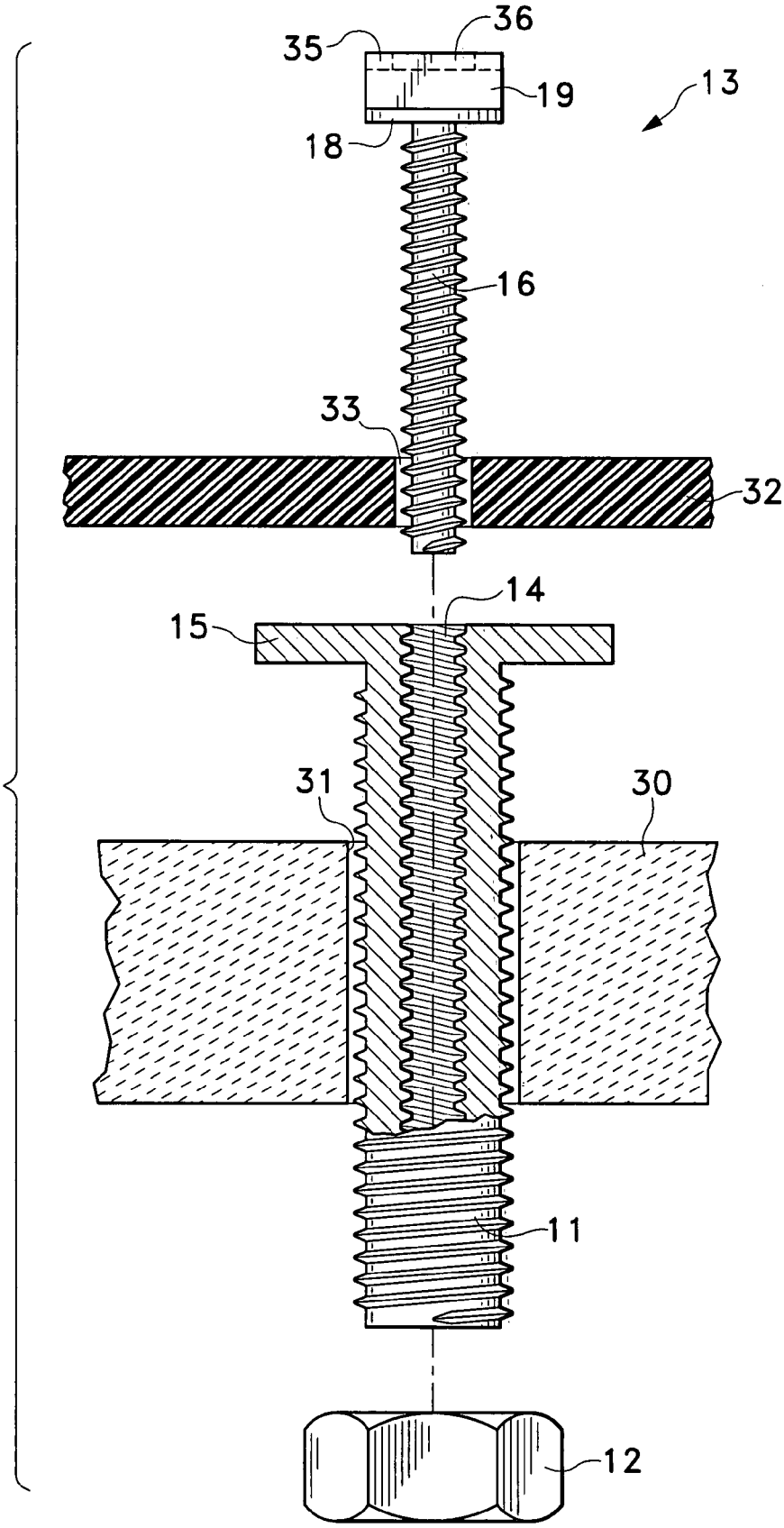
FIG. 8 is an exploded view of the partial vertical section of FIG. 3.

To use the bolt assemblies 10 the three parts may be disengaged and one bolt 11 may be inserted downwardly into each of the vertical openings 31 in the toilet bowl flange 30. The bolts 11 may be secured within the openings 31 with the nuts 12 from below the flange 30. Once secured, the bolts 11 and nuts 12 need not be disturbed again. The toilet seat bracket 32 may then be placed onto the flange 30 so that the openings 33 in the bracket 32 may be aligned with the bores 14 in the bolts 11. The shaft 16 of each screw 13 may then be inserted through the openings 33 in the bracket 32 and threaded into the bores 14 until the plates 18 rest flush against the bracket 32. See FIGS. 3 and 8. This may be accomplished by hand without any tool or with the aid of a screwdriver.

To remove the seat assembly for cleaning, or changing, it may only be necessary to remove the screws 13 (or 25) and lift the toilet seat bracket 32 upward away from the flange 30. To replace the seat, put the bracket openings 33 over the bores 14 in the bolts 11 and replace the screws 13 (or 25). This may be repeated as often as necessary. The screws 13 (or 25) are removed by turning them within the threaded bores 14, and, if properly performed, the screws and bores should not wear out since neither part may experience stress from repeated proper use. The bolt 11 may extend well below the flange 30 out of sight and may be made long enough to accommodate flanges of varied thickness.

This bolt assembly 10 may be used for other fastening needs as well as for toilet seats where one part must be permanently fastened and the other subject to frequent removal.

Figure 6:
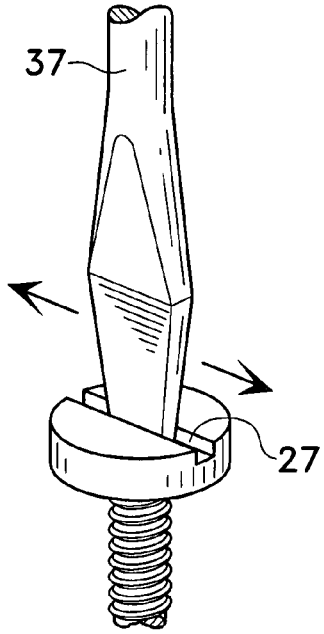
FIG. 6 (PRIOR ART)
FIG. 6 is a perspective view of a prior art screw and screwdriver head.
Figure 7:
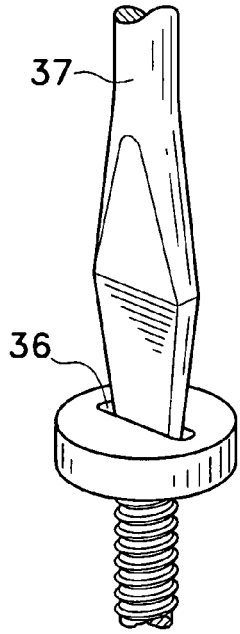
FIG. 7 is a perspective view of the embodiment of FIG. 5 and screwdriver head.

The screws 13 and 25 described above both may have large heads and when a screwdriver is used to tighten them the screwdriver can easily slip sideways within the horizontal slots 20 and 27. To make it easier and more efficient to use the screwdriver, the slots may be made smaller by either filling in the opposing ends with a filler material 35 after manufacture, or manufacturing the screws with smaller slots 36 that do not extend the full width of the screw heads but may be wide enough to accommodate a screwdriver of the appropriate size for that screw. FIG. 6 may show a screw of the prior art wherein the screwdriver may slip horizontally during use. FIG. 7 may show a screw of the present invention wherein the screwdriver 37 fits properly but not tightly, yet cannot slip out during use.

The bolt assembly 10 of the present invention may be manufactured of any rigid material, such as a metal, a plastic or a polymeric material. Nylon may be preferable since it may easily be formed into the required shapes, is not subject to corrosion, and may retain its shape after repeated use.

While embodiments of the present invention have been illustrated and described in detail, it is to be understood that this invention is not limited thereto and may be otherwise practiced within the scope of the following claims.

This parts list is for examination purposes only and should not be published with the patent.

| Richter PARTS LIST | |
|---|---|
| 10 | Bolt assembly |
| 11 | Bolt |
| 12 | Nut |
| 13 | Screw |
| 14 | Threaded aperture in bolt |
| 15 | Collar on bolt |
| 16 | Shaft of screw |
| 17 | Head of screw |
| 18 | Plate of screw top |
| 19 | Grip of screw top |
| 20 | Slot in screw grip |
| 21 | |
| 22 | |
| 23 | |
| 24 | |
| 25 | Second embodiment of screw |
| 26 | Screw head |
| 27 | Slot in screw head |
| 28 | |
| 29 | |
| 30 | Toilet bowl flange |
| 31 | Opening in flange |
| 32 | Toilet set bracket |
| 33 | Opening in bracket |
| 34 | |
| 35 | Filling in sides of slot |
| 36 | Smaller slot |
| 37 | Screw driver |
| 38 | |
| 39 | |
| 40 | |

I claim:

1. A bolt assembly in combination with a toilet seat assembly with a mounting bracket having at least one aperture therethrough, said bolt assembly allows said toilet seat assembly to be mounted on a toilet bowl flange having at least one corresponding vertical opening, said bolt assembly consisting of:

at least one threaded bolt having a threaded exterior surface and an axial threaded bore, an upper end and a lower end, and a collar about the upper end, said collar being larger in diameter than the vertical opening in the flange, and said bolt being substantially longer than the thickness of the flange;

at least one nut having a threaded axial opening to cooperate with the threading on the exterior surface of the threaded bolt, said nut being threaded onto the threaded exterior surface at the lower end of the at least one bolt after the at least one bolt has been inserted downwardly into the at least one vertical opening in the flange, the at least one nut securely affixing said at least one bolt to the flange and insuring that the at least one bolt is immovable therein; and at least one screw, being shorter that the at least one bolt, having a threaded shaft to cooperate with the threaded bore and a head which the head of comprises an integral plate having an upper surface and a lower surface and being larger in diameter than the at least one aperture in the mounting bracket and a grip substantially in the form of a rectangular solid integral and disposed on the upper surface of said plate such that when the mounting bracket is placed over the flange and the at least one aperture is directly over the bore in the at least one bolt and the at least one screw is passed through the at least one aperture and threaded into the bore by grasping the head of said screw and rotating said screw in a first direction the mounting bracket and thereby the toilet seat assembly is secured to the flange, and when the head of the at least one screw is grasped and rotated in a second opposite direction and removed from the bore the toilet seat assembly is completely removed from the flange;

whereby the toilet seat assembly is easily completely removed for cleaning and is just as easily replaced after cleaning.

2. A bolt assembly as described in claim 1 wherein the collar of the at least one bolt further comprises a flat top surface and a flat bottom surface for a flush fit against the flange and the attaching bracket.

3. A bolt assembly as described in claim 1 wherein the bolt is of sufficient length to accommodate variations in the thickness of the flange.

4. A bolt assembly as described in claim 1 further comprising a horizontal slot across the top surface of the grip from one edge to the other to accommodate a screwdriver.

5. A bolt assembly as described in claim 4 wherein the horizontal slot has been filled in on each end leaving a slot in the center of the top surface of the grip of a width to accommodate a screwdriver whereby the screwdriver cannot slip sideways during use.

6. A bolt assembly as described in claim 1 further comprising a horizontal slot in the center of the top surface of the grip of a width to accommodate a screwdriver whereby the screwdriver cannot slip sideways during use.

7. A bolt assembly as described in claim 1 wherein the head of the at least one screw comprises a plate having a horizontal slot across the top surface thereof from one edge to the other to accommodate a screwdriver.

8. A bolt assembly as described in claim 7 wherein the horizontal slot has been filled in on each end leaving a slot in the center of the top surface of the plate of a width to accommodate a screwdriver whereby the screwdriver cannot slip laterally during use.

9. A bolt assembly as described in claim 1 wherein the head of the at least one screw comprises a plate having a horizontal slot in the center of the top surface thereof and being of a width to accommodate a screwdriver whereby the screwdriver cannot slip sideways during use.

10. A bolt assembly in combination with a toilet seat assembly with a mounting bracket having at least one aperture therethrough, said bolt assembly allows said toilet seat assembly to be mounted on a toilet bowl flange having at least one corresponding vertical opening, said bolt assembly consisting of:

at least one threaded bolt having a threaded exterior surface and an axial threaded bore, an upper end and a lower end, and a collar about the upper end, said collar being larger in diameter than the vertical opening in the flange, and said bolt being substantially longer than the thickness of the flange;

at least one nut having a threaded axial opening to cooperate with the threading on the exterior surface of the threaded bolt, said nut being threaded onto the threaded exterior surface at the lower end of the at least one bolt after the at least one bolt has been inserted downwardly into the at least one vertical opening in the flange, the at least one nut securely affixing said at least one bolt to the flange and insuring that the at least one bolt is immovable therein; and at least one screw, being shorter that the at least one bolt, having a threaded shaft to cooperate with the at threaded bore, and a head comprising an integral plate having an upper surface and a lower surface and being larger in diameter than the at least one aperture in the mounting bracket and a grip integral with and disposed on the upper surface of the plate, such that when the mounting bracket is placed over the flange and the at least one aperture is directly over the bore in the at least one bolt, the at least one screw is passed through the at least one aperture and threaded into the bore by grasping and rotating said screw in a first direction the mounting bracket and thereby the toilet seat assembly is secured to the flange, and when the at least one screw is grasped and rotated in a second opposite direction and removed from the bore the mounting bracket and thereby the toilet seat assembly is completely removed from the flange;

whereby the toilet seat assembly is easily completely removed for cleaning and is just as easily replaced after cleaning.

11. A bolt assembly as described in claim 10 further comprising a horizontal slot across the top surface of the grip from one edge to the other to accommodate a screwdriver.

12. A bolt assembly as described in claim 11 wherein the horizontal slot has been filled in on each end leaving a slot in the center of the top surface of the grip of a width to accommodate a screwdriver whereby the screwdriver cannot slip laterally during use.

13. A bolt assembly as described in claim 10 further comprising a horizontal slot in the center of the top surface of the grip of a width to accommodate a screwdriver whereby the screwdriver cannot slip laterally during use.

14. A bolt assembly in combination with a toilet seat assembly with a mounting bracket having at least one aperture therethrough, said bolt assembly allows said toilet seat assembly to be mounted on a toilet bowl flange having at least one corresponding vertical opening, said bolt assembly consisting of:

at least one threaded bolt having a threaded exterior surface and an axial threaded bore, an upper end and a lower end, and a collar about the upper end, said collar being larger in diameter than the vertical opening in the flange, and said bolt being substantially longer than the thickness of the flange;

at least one nut having a threaded axial opening to cooperate with the threading on the exterior surface of the threaded bolt, said nut being threaded onto the threaded exterior surface at the lower end of the at least one bolt after the at least one bolt has been inserted downwardly into the at least one vertical opening in the flange, the at least one nut securely affixing said at least one bolt to the flange and insuring that the at least one bolt is immovable therein; and at least one screw, being shorter that the at least one bolt, having a threaded shaft to cooperate with the at threaded bore, and an integral head comprising a plate having an upper surface and a lower surface and being larger in diameter than the at least one aperture in the mounting bracket, a grip integral with and disposed on the upper surface of the plate, and a horizontal slot in the center of the top surface of the grip of a width to accommodate a screwdriver whereby the screwdriver cannot slip laterally during use, and such that when the mounting bracket is placed over the flange and the at least one aperture is directly over the bore in the at least one bolt, the at least one screw is passed through the at least one aperture and threaded into the bore by rotating said screw in a first direction the mounting bracket and thereby the toilet seat assembly is secured to the flange, and when the at least one screw is rotated in a second opposite direction and removed from the bore the mounting bracket and thereby the toilet seat assembly is completely removed from the flange and the user can also grasp the head by the grip and rotate the screw in the first direction to secure the shaft within the bore or in the second direction to remove it therefrom;

whereby the toilet seat assembly is easily completely removed for cleaning and is just as easily replaced after cleaning.

* * * * *